United States Patent [19]

Proulx

[11] 4,076,011

[45] Feb. 28, 1978

[54] WARM AIR HEATING AND FIRE-PLACE SYSTEM

[76] Inventor: Roger Proulx, 383 Laurier Street, Otterburn Park, Rouville, Canada

[21] Appl. No.: 697,955

[22] Filed: Jun. 21, 1976

[51] Int. Cl.[2] ..... F24B 7/02

[52] U.S. Cl. ..... 126/121; 237/51; 219/279; 219/367; 219/368

[58] Field of Search ..... 237/51, 1 A, 8 R; 126/121

[56] References Cited

U.S. PATENT DOCUMENTS

| | | | |
|---|---|---|---|
| 2,471,351 | 5/1949 | Russell | 237/51 |
| 2,572,888 | 10/1951 | Stein | 237/51 |
| 3,096,754 | 7/1963 | Howrey | 126/121 X |
| 3,958,755 | 5/1976 | Cleer, Jr. | 126/132 X |
| 3,999,535 | 12/1976 | Hall | 126/121 |

*Primary Examiner*—William E. Wayner

*Assistant Examiner*—William E. Tapolcai, Jr.

[57] ABSTRACT

A warm air heating system which efficiently and inexpensively combines a fire-place to another warm air heating device or unit to form a balanced warm air heating system and thus efficiently use the heat output of the fire-place. This warm air heating system comprises an air plenum housing and a fire-place; the air plenum housing includes air ducts, an air blower, an air flow distribution valve, an electric heating device, an actuator for the valve, and air inlets and outlets and the fire-place includes an air heating space and is connected to the air plenum housing with a thermostatic control for the actuator. Therefore, upon heating of the fire-place, more air will be circulated through the fire-place by proper operation of the valve by the actuator and less air will be heated by the electric heating device to efficiently use the heat output of the fire-place.

4 Claims, 7 Drawing Figures

WARM AIR HEATING AND FIRE-PLACE SYSTEM

This invention relates to a warm air heating system and, more particularly, to a warm air heating system of the type including a fire-place in combination with another warm air heating device.

At present, there is a great desire to optimize efficient use of energy for domestic heating and thus to counter the fast rising cost of hydrocarbon fuels. For this purpose, many homes are adding a fire-place to supplement the conventional heating system. The fire-places are now currently built separate from the main automatic heating system. There results lack of coordination or proper interrelationship between the heat outputs and a substantial waste of heat through unbalanced heating. Besides, unbalanced heating in itself is disadvantageous due to the associated uncomfort. In other words, with the above-mentioned separate arrangements, the main automatic heating system at times operates concurrently with the fire-place and produces excess heat in the area of the fire-place and often not enough heat in other areas.

It is a general object of the present invention to provide a warm air heating system of the above type wherein advantageous use is made of the heat output of the fire-place for overall heating of a home or place.

It is another general object of the present invention to provide a warm air heating system of the above type, which avoids the above-mentioned disadvantages and in particular which provides balanced heating while both the fire-place and the main automatic heating system concurrently operate.

It is a more specific object of the present invention to provide a warm air heating system of the above type which efficiently and inexpensively combines a fire-place to another warm air heating device or unit into a balanced heating system.

The above and other objects and advantages of the present invention will be better understood with reference to the accompanying detailed description of a preferred embodiment thereof which is illustrated, by way of example, in the accompanying drawings, in which.

Figures 3, 4, 5, 6:
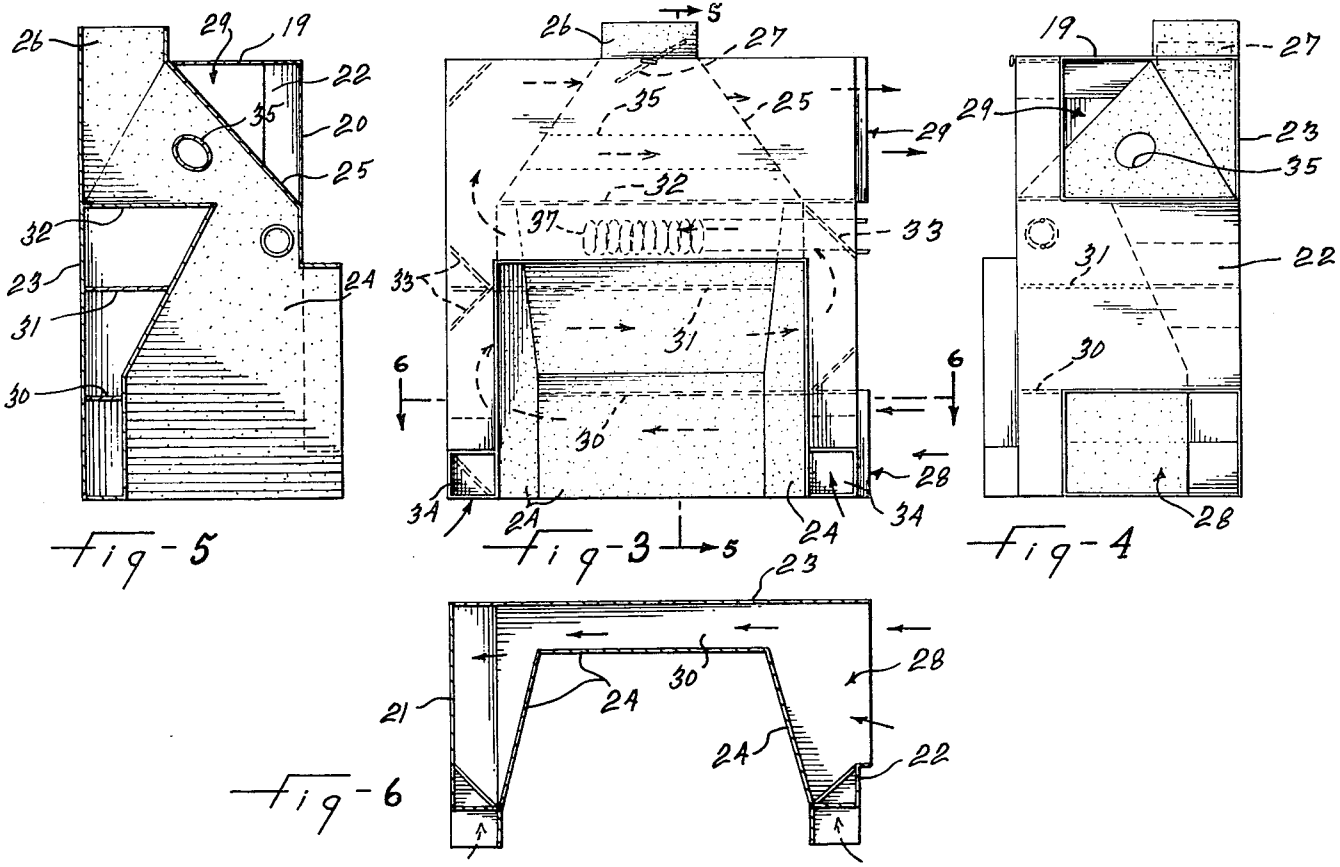

FIGS. 3, 4, and 5 are front, right side and left side views respectively of the fire-place alone;

FIG. 6 is a cross-sectional view as seen along line 6—6 in FIG. 3; and

Figure 1:
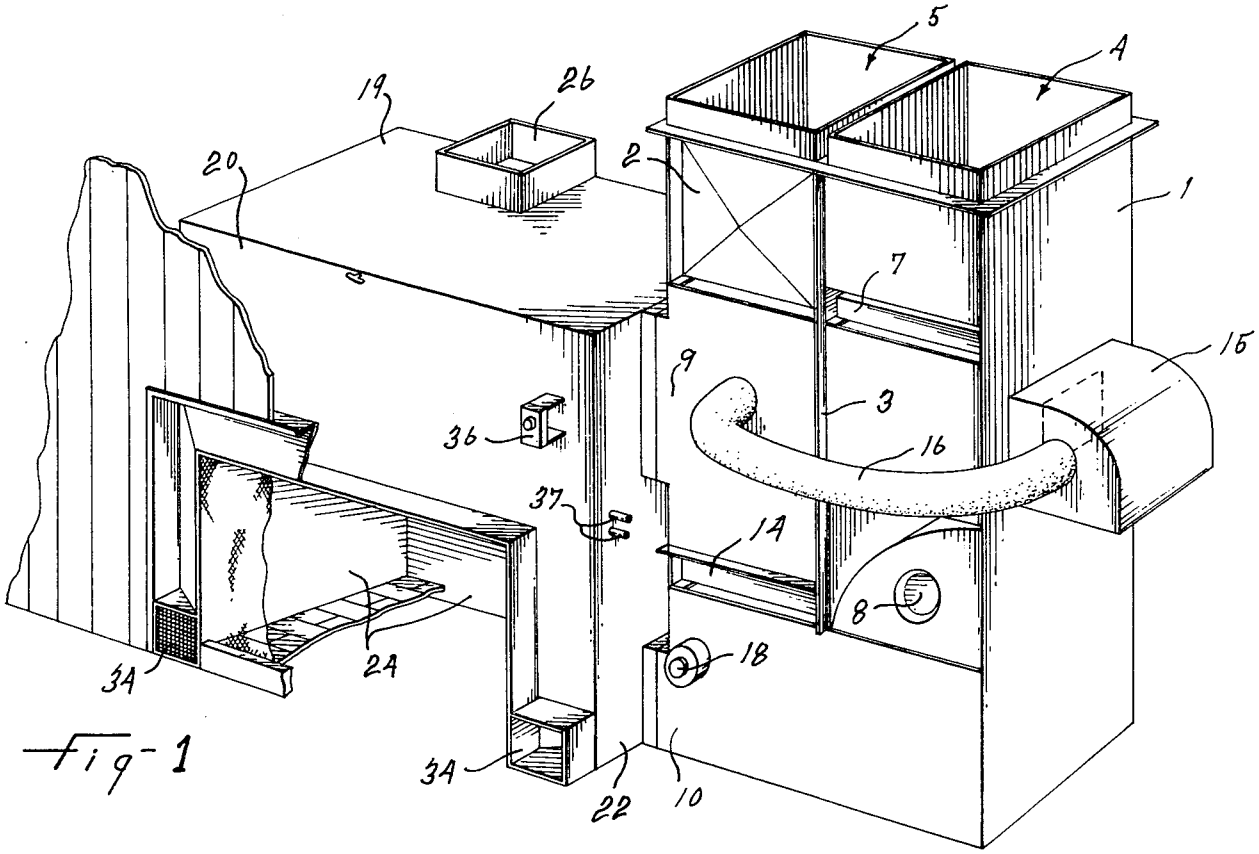
FIG. 1 is a perspective view of a warm air heating and fire-place system according to the present invention.
Figure 7:
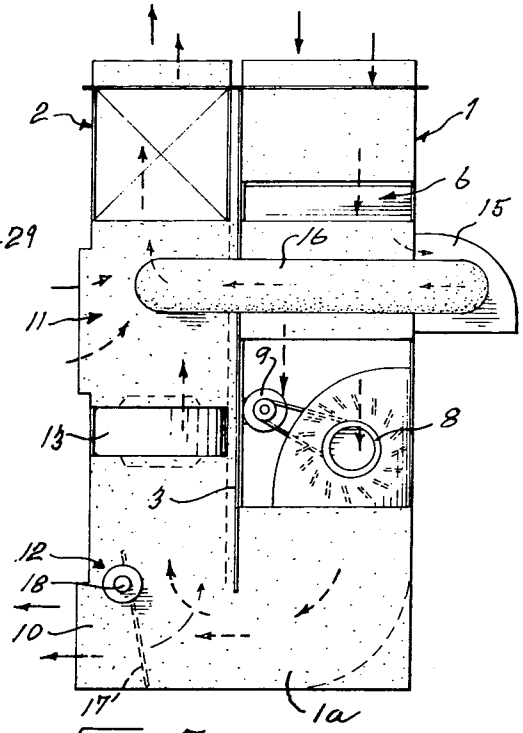
Figure 2:
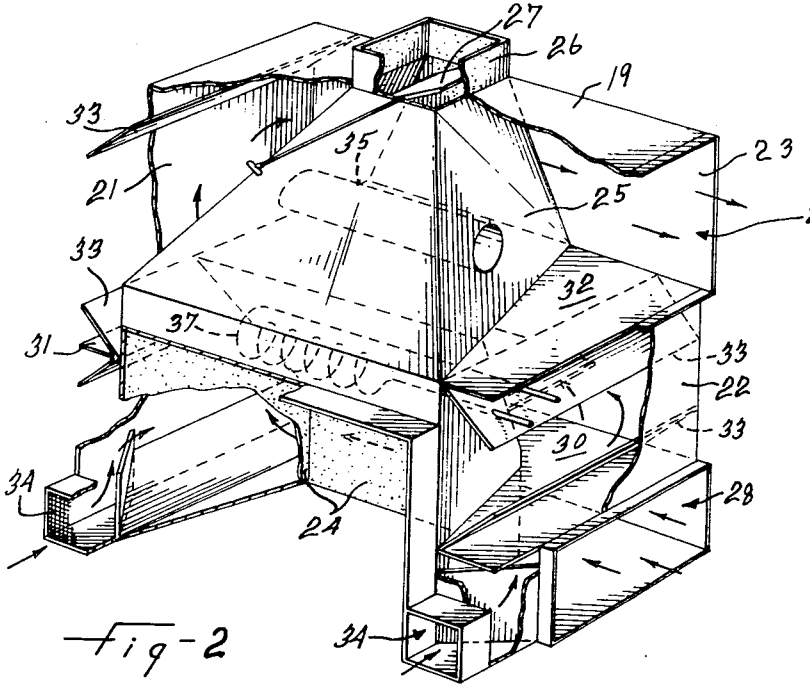
FIG. 2 is a perspective view of the fire-place alone.

FIG. 7, on the same sheet as FIG. 2, is a front elevation view of an air plenum housing unit forming part of the system of FIG. 1.

The illustrated warm air heating and fire-place system of FIG. 1 essentially includes two distinct and cooperating components: a fire-place and an air plenum housing unit.

The air plenum housing unit, shown in FIGS. 1 and 7 only, includes an air plenum housing 1*a*, of generally rectangular shape, communicating at the top with a first and a second upright air ducts 1 and 2 disposed side by side and upstanding from housing 1*a*; inner wall 3 of duct 2 extends downwardly into housing 1*a* short of the bottom of the air plenum housing 1*a* and thus produces communication between the two air ducts 1 and 2, as seen in FIG. 7. The first upright air duct 1 has an open top 4 constituting a cold air inlet. Similarly, the second upright air duct 2 has an open top 5 constituting a warm air outlet. These cold air inlet and warm air outlet are arranged to be connected to conventional cold air and warm air ductworks.

A compartment 6 is formed in the first air duct 1 to receive an air filter, not shown, of any appropriate type. This air filter, for instance, may be of the electronic type and accessible by a door 7 in the wall of the air duct. An air blower including an air impeller drum 8 and a motor 9 is mounted in the first air duct 1 for forced air circulation in and out of the air plenum housing, as shown by the arrows in FIG. 7. In FIGS. 1 and 7, a side panel is removed to show the internally-mounted air blower.

The air plenum housing is formed with a cold air outlet 10 and a warm air inlet 11 in one side thereof with the warm air inlet spaced above the cold air outlet.

An air flow distribution valve 12 is formed at the bottom of the air plenum housing and defines an inlet and a pair of outlets. The first air duct 1 extends between the cold air inlet formed by the open top 4 and the inlet of the air flow distribution valve 12. The second air duct 2 extends between one outlet of the air flow deflection valve 12 and the warm air outlet formed by the open top 5. A compartment is formed in the second air duct 2 in which is mounted an electric heating unit 13, of any appropriate type. A door 14 in the wall of the second air duct 2 gives access to the electric heating unit 13. The latter is positioned intermediate the cold air outlet 10 and the warm air inlet 11. A humidifier 15, of conventional construction, such as of the rotating drum type, is fixed to the air plenum housing and supplies moist air in the second air duct 2 at the warm air inlet 11 by a tube 16.

The air flow deflection valve 12 includes a pivotable air deflection vane 17 which pivots about a transverse axis between one extreme position fully closing one of its outlet and opening the other and another extreme position fully closing the other outlet and opening said one outlet. A rotary electric actuator 18 is fixed to the vane 17 to adjustably pivot the latter between the two extreme positions thereof. Thus, the air flow produced by the air blower is adjustably distributed by the air deflection vane 17 between the second air duct 2 and the fire-place which is hereinaftr described in details with reference to FIGS. 1 and 6 inclusive.

The illustrated fire-place includes an outer casing having a top 19, a front 20, left side 21, right side 22 and a rear 23. A fire chamber enclosure 24 is mounted in the above-mentioned outer housing and is separated from the latter by an air heating space. The upper portion 25 of the enclosure 24 forms a pyramidal bonnet outwardly opening above the top 19 of the outer casing of the fire-place to form a base 26 for a smoke stack, not shown. A draft damper 27 is conventionally pivoted at the junction between the bonnet 25 and the base 26 to control the draft up the smoke stack or chimney.

The right side wall 22 of the outer casing of the fire-place is formed with a cold air inlet aperture 28 and a warm air outlet aperture 29 which are upwardly spaced, whereby these inlet and outlet apertures communicate with the bottom and the top, respectively, of the air heating space. These inlet and outlet apertures are directly connected to the cold air outlet 10 and the warm air inlet 11 respectively, as shown in FIG. 1, or may be connected by appropriate air ducts if the fire-place is installed at a distance from the air plenum housing unit. The air heating space between the outer casing and the internal enclosure of the fire-place is provided with horizontal baffle plates 30, 31, and 32. These baffle plates are connected along their opposite lateral edges to the outer casing and the internal enclosure; project endwise from one side wall; and end short of the other, as shown in FIG. 3, to form a milti-pass air passage, or path, extending from the inlet aperture 28 to the outlet aperture 29. Baffles 33 are angularly fixed at the ends of the air passes against the sidewalls 21 and 22 to deflect the air downstream along the successive passes. The frnt 20 of the fire-place is formed with a pair of bottom air inlets 34 communicating with the air heating space around the internal enclosure 24. Thus, air may be drawn through the air inlets 34 to be heated by the fire-place.

A tube 35 transversely extends through the pyramidal bonnet 25 to heat the air with the heat of the smoke passing the bonnet.

A thermostatic control, or thermostat 36, is mounted on the front 20 of the outer housing of the fire-place and arranged to measure the heat output of the fire-place. This thermostat 36 is connected to the rotary electric actuator 18 to energize the latter and angularly adjust the air deflection vane 17 in relation with the heat output of the fire-place. Thus, when substantial heat is produced by the fire-place, the deflection vane 17 reduces the air flow through the second air duct 2 and the heat output by the electric heating unit 13. The heat output of the fire-place is thus used to reduce the heat demand on the electric heating unit 13 which is used as the main heating device.

A water heating pipe 37 is coiled in the air heating space of the fire-place and connected to the hot water supply tank to heat the water in the latter.

It will be noted that the assembly of air plenum housing 1*a* and upright air ducts 1 and 2 can be conveniently located behind the housing inner wall through which opens the chamber enclosure 24. For this purpose, this assembly is disposed in lateral alignment with the outer casing of the fire-place and the front walls of housing 1*a* and ducts 1 and 2 are generally co-planar and recessed from the front wall 20 of the outer casing.

It must be noted that many changes in the details of construction may be made without departing from the spirit and scope of the invention defined by the appended claims.

What is claimed is:

1. A warm air heating and fire-place system comprising, in combination, an open hearth jacketed fire-place opened at the front and including an outer casing and an inner wood-burning chamber separated from the outer casing by an air heating space, a bonnet upstanding from, and in communication with, the top of said chamber at its lower end, extending through said heating space and adapted to communicate with a smoke stack at its upper end, said outer casing having a side wall provided with a lower air inlet and an upper air outlet, and an auxiliary air heating assembly comprising an air plenum housing disposed adjacent said side wall of said outer casing and having a lateral outlet communicating with said lower air inlet of said outer casing, first and second upright air conduits disposed side by side on top of said air plenum housing and having lower ends in direct communication with said air plenum housing, said second upright air conduit being disposed adjacent said side wall of said housing and said first upright conduit being disposed in the opposite side of said second upright air conduit with respect to said outer casing, said outer casing, air plenum housing and first and second upright air conduits being in general alignment, said first and second upright air conduits having top ends adapted to be connected to the return air conduit network and the warm air conduit network, respectively of a house to be heated, said second upright air conduit having a lateral opening spaced upwardly from the lateral opening of said air plenum housing and in direct communication with said upper air outlet of said outer casing, a motor-operated air blower located within said first upright air conduit to circulate air downwardly within said first upright air conduit from its top ends towards said air plenum housing and from said air plenum housing either through said air heating space within said outer casing and then to issue through the open top end of said second upright air conduit or directly from said air plenum housing through said second upright air conduit to its open top end, an electric heating element mounted within the assembly of said first and second upright air conduits and said air plenum housing, downstream from said air blower, and valve means mounted within said assembly and operable to take a first limit position in which said valve means block air circulation through said air heating space within said outer casing, while they allow direct air circulation frm said air plenum housing upwardly through said second upright air conduit and a second limit position in which said valve means block air circulation from said air plenum housing through said second upright air conduit, while they allow air circulation from said air plenum housing through said air heating space of said outer casing and back into said second upright air conduit through said upper air outlet of said outer casing, so arranged that, when said electric heating element is operating, air heated thereby can flow directly from said first to said second upright air conduit without circulating through said outer space where the heated air would lose heat in heat exchange with said inner chamber.

2. A warm air heating and fire-place system as claimed in claim 1, wherein said outer casing has a back wall and a front wall and said assembly of said first and second upright air conduits and of said air plenum housing have substantially co-planar front walls, the front walls of said assembly being recessed with respect to the front wall of said outer casing.

3. A warm air heating and fire-place system as claimed in claim 1, wherein said bonnet is of generally pyramidal shape and further including a tube transversely extending through the pyramidal bonnet and opening within said air heating space at both ends for the passage of air therethrough to be heated by the hot gases flowing through said bonnet.

4. A system as claimed in claim 1, further including an air humidifier device including a casing, air humidifier means within said casing, said casing having an inlet in direct communication with the portion of said second upright air conduit upstream from said air blower and having an outlet in communication with said first upright air conduit.

* * * * *